US011434553B2

(12) United States Patent
Zhang et al.

(10) Patent No.: US 11,434,553 B2
(45) Date of Patent: Sep. 6, 2022

(54) LOW COST LEAN PRODUCTION BAINITIC STEEL WHEEL FOR RAIL TRANSIT, AND MANUFACTURING METHOD THEREFOR

(71) Applicants: MAGANG (GROUP) HOLDING CO.,LTD., Maanshan (CN); MAANSHAN IRON & STEEL CO.,LTD., Maanshan (CN)

(72) Inventors: Mingru Zhang, Maanshan (CN); Hai Zhao, Maanshan (CN); Zheng Fang, Maanshan (CN); Feng Zhang, Maanshan (CN); Rongjie Deng, Maanshan (CN); Manli Sun, Maanshan (CN)

(73) Assignees: MAGANG (GROUP) HOLDING CO., LTD., Maanshan (CN); MAANSHAN IRON & STEELC O., LTD., Maanshan (CN)

( * ) Notice: Subject to any disclaimer, the term of this patent is extended or adjusted under 35 U.S.C. 154(b) by 285 days.

(21) Appl. No.: 16/314,394

(22) PCT Filed: Jul. 6, 2017

(86) PCT No.: PCT/CN2017/091919
§ 371 (c)(1),
(2) Date: Dec. 29, 2018

(87) PCT Pub. No.: WO2018/006843
PCT Pub. Date: Jan. 11, 2018

(65) Prior Publication Data

US 2019/0144979 A1 May 16, 2019

(30) Foreign Application Priority Data

Jul. 6, 2016 (CN) ..... 201610528416.X

(51) Int. Cl.
*C22C 38/04* (2006.01)
*C22C 38/02* (2006.01)
(Continued)

(52) U.S. Cl.
CPC ..... *C22C 38/04* (2013.01); *C21D 1/18* (2013.01); *C21D 1/28* (2013.01); *C21D 6/005* (2013.01);
(Continued)

(58) Field of Classification Search
CPC ..... C21D 1/18; C21D 1/28; C21D 2211/001; C21D 2211/002; C21D 6/005;
(Continued)

(56) References Cited

U.S. PATENT DOCUMENTS

2010/0276955 A1* 11/2010 Chen ..... C21D 9/34 295/30
2012/0152410 A1* 6/2012 Sikora ..... C21D 9/0006 148/530

FOREIGN PATENT DOCUMENTS

CN 1800427 A * 7/2006
CN 1800427 A 7/2006
(Continued)

OTHER PUBLICATIONS

The structure stability of carbide-free bainite wheel steel Mingru Zhang, Jianqing Qian, Haicheng Gu vol. 16(5) Journal of Materials Engineering and performance (Year: 2007).*
(Continued)

*Primary Examiner* — Jenny R Wu

(57) ABSTRACT

The present invention discloses a low cost lean production bainitic steel wheel for rail transit and a manufacturing method therefor. The steel wheel contains elements with the following weight percentages: carbon C: 0.15-0.45%, silicon Si: 1.00-2.50%, manganese Mn: 1.20-3.00%, rare earth
(Continued)

RE: 0.001-0.040%, phosphorus P≤0.020%, and sulphur S≤0.020%, where the remaining is iron and unavoidable residual elements, and 3.00%≤Si+Mn≤5.00%. Compared with the prior art, through alloying design and a preparation process, especially a heat treatment process and technology, a rim of the wheel obtains a carbide-free bainite structure, and a web and a wheel hub obtain granular bainite, a supersaturated ferritic structure, and a small amount of pearlite. The wheel has high comprehensive mechanical properties and service performance. In addition, the heat treatment process and technology are fully used without particularly adding alloying elements such as Mo, Ni, V, Cr, and B, to greatly reduce costs of steel and realize lean production.

8 Claims, 6 Drawing Sheets

(51) Int. Cl.

| | |
|---|---|
| ***C21D 1/28*** | (2006.01) |
| ***C21D 1/18*** | (2006.01) |
| ***C22C 38/00*** | (2006.01) |
| ***C21D 6/00*** | (2006.01) |
| ***C21D 9/34*** | (2006.01) |

(52) U.S. Cl.
CPC ..... *C21D 6/008* (2013.01); *C21D 9/34* (2013.01); *C22C 38/005* (2013.01); *C22C 38/02* (2013.01); *C21D 2211/001* (2013.01); *C21D 2211/002* (2013.01)

(58) Field of Classification Search
CPC ..... C21D 6/008; C21D 9/34; C22C 38/005; C22C 38/02; C22C 38/04
See application file for complete search history.

(56) References Cited

FOREIGN PATENT DOCUMENTS

| | | |
|---|---|---|
| CN | 106191666 A | 12/2016 |
| WO | WO2012048841 A1 | 4/2012 |

OTHER PUBLICATIONS

Microstructure and properties of carbide free bainite railway wheels produced by programmed quenching M. R. Zhang and H.C. Gu Material Science and Technology vol. 23, No. 8 (Year: 2007).*

Effect of Rare Earth elements on Isothermal Transformation kinetics in Si—Mn—Mo bainite steels Yilong Liang, Yanliang Yi, Shaolei Long and Qibing Tan Journal of Materials Engineering and Performance vol. 23(12) (Year: 2014).*

Zhang, Mingru et al., The Application Prospects for the Free-Carbide Bainite Wheel, ANHUI METALLURGY, No. 4 , Dec. 31, 2001 (Dec. 31, 2001), p. 3, left-hand.

* cited by examiner

Bainite wheel CL60 wheel

LOW COST LEAN PRODUCTION BAINITIC STEEL WHEEL FOR RAIL TRANSIT, AND MANUFACTURING METHOD THEREFOR

CROSS REFERENCE TO RELATED APPLICATION

This application is a national stage application of International application number PCT/CN2017/091919, filed Jul. 6, 2017, titled "LOW COST LEAN PRODUCTION BAINITIC STEEL WHEEL FOR RAIL TRANSIT, AND MANUFACTURING METHOD THEREFOR," which claims the priority benefit of Chinese Patent Application No. 201610528416X, filed on Jul. 6, 2016, which is hereby incorporated by reference in its entirety.

TECHNICAL FIELD

The present invention belongs to the field of steel preparation, and specifically, relates to a low cost lean production bainitic steel wheel for rail transit and manufacturing method therefor. The steel design and manufacturing method of bainite steel wheel and other similar elements for rail transit are realized at low costs and through lean production.

BACKGROUND

"High speed, heavy load, and low noise" are main development directions of world rail transit. Wheel is the "shoe" of the rail transit, which is one of the most important runner elements and directly affects traveling safety. In a normal train running process, wheels bear a full load weight of a vehicle, and are subject to wear and rolling contact fatigue (RCF) damage. In addition, more importantly, wheels have a very complex interaction relationship with steel rails, brake shoes, axletrees, and surrounding media, and are in a dynamic alternating stress state. Especially, the wheels and the steel rails, and the wheels and the brake shoes (except for disc brakes) are two pairs of friction couples that always exist and cannot be ignored. In an emergency or during running on a special road, brake thermal damage and abrasion are very significant, which cause thermal fatigue and also affect wheel safety and a service life.

In rail transit for heavy load freight transport, when wheels satisfy basic strength, particular attention is paid to a roughness indicator of the wheels, to ensure safety and reliability. Freight transport wheels are seriously worn and have serious rolling contact fatigue (RCF) damage. In addition, tread braking is used for the wheels, which causes serious thermal fatigue damage, leading to defects such as peeling, flaking, and rim cracking.

Currently, national and international wheel steel for rail transit, for example, Chinese wheel standards GB/T8601 and TB/T2817, European wheel standard EN13262, Japanese wheel standard JRS and JISB5402, and North American wheel standard AARM107, uses medium-to-high carbon steel or medium-to-high carbon microalloyed steel, where microstructures of both are of a pearlite-ferritic structure.

CL60 wheel steel is the main rolled wheel steel used in Chinese current rail transit vehicles (for passenger and freight transport), and BZ-L wheel steel is the main cast wheel steel used in Chinese current rail transit vehicles (for freight transport), where microstructures of both are of a pearlite-ferritic structure.

For a schematic diagram of names of wheel elements, refer to FIG. 1, and for main technical indicators of CL60 steel, refer to Table 1.

TABLE 1

Main technical requirements for CL60 wheel Steels

| | Component, wt % | | | Rim performance requirement | | | |
|---|---|---|---|---|---|---|---|
| Material | C | Si | Mn | $R_m$, MPa | A % | Z % | Hardness, HB |
| CL60 | 0.55-0.65 | 0.17-0.37 | 0.50-0.80 | >910 | >10 | >14 | 265-320 |

In a production and manufacturing process, to ensure good quality of a wheel, content of harmful gas and content of harmful residual elements in steel need to be slow. When the wheel is in a high-temperature state, a rim tread is intensively cooled with a water spray, to improve strength and hardness of a rim. This is equivalent to that normalizing heat treatment is performed on a web and a wheel hub, so that the rim has high strength-roughness matching, and the web has high roughness, thereby finally realizing excellent comprehensive mechanical properties and service performance of the wheel.

In wheel steel having pearlite and a small amount of ferritic, the ferritic is the soft domain material, having good toughness and low yield strength. The ferritic is soft and therefore, has poor rolling contact fatigue (RCF) resistance performance. Generally, higher content of the ferritic leads to better impact toughness of the steel. Compared with the ferritic, the pearlite has higher strength and poorer roughness, and therefore has poorer impact performance. Because the rail transit develops towards high speed and heavy load. Load borne by a wheel will be significantly increased during running, causing that the existing wheel made of pearlite and a small amount of ferritic has more problems exposed in running service process. Several main disadvantages are as follows:

(1) A rim has low yield strength, which generally does not exceed 600 MPa. During wheel running, because a rolling contact stress between a wheel and a rail is relatively large, which sometimes exceeds yield strength of wheel steel, plastic deformation is caused to the wheel during a running process, leading to plastic deformation of a tread subsurface. In addition, because brittle phases such as inclusions and cementite exist in steel, the rim is prone to micro-cracks. The micro-cracks cause detects such as peeling and rim cracking under the action of rolling contact fatigue during wheel running.

(2) High carbon content in the steel causes a poor thermal damage resistance capability. When tread braking is used or friction damage is caused during wheel slipping, temperature of a part of the wheel is increased to the austenitizing temperature of the steel. Then the steel is chilled to produce martensite. By such repeated thermal fatigue, thermal cracks on a brake are generated and detects such as flaking and spalling are caused.

(3) The wheel steel has poor hardenability. The rim of the wheel has a particular hardness gradient and hardness is uneven, which easily causes detects such as wheel flange wear and non-circularity.

With development and breakthrough of the research on a bainite phase change in steel, especially the research on theories and application of carbide-free bainite steel, good matching between high-strength and high-toughness can be realized. The carbide-free bainite steel has an ideal microstructure, and also has excellent mechanical properties. A fine microstructure of the carbide-free bainite steel is carbide-free bainite, namely, supersaturated lathy ferritic in nanometer scale, in the middle of which film-shaped carbon-rich residual austenite in nanometer scale exists, thereby improving the strength and toughness of the steel, especially the yield strength, impact toughness, and fracture toughness of the steel, and reducing notch sensitivity of the steel. Therefore, by using a bainite steel wheel, rolling contact fatigue (RCF) resistance performance of the wheel is effectively increased, phenomena of wheel peeling and flaking are reduced, and safety performance and service performance of the wheel are improved. Because the bainite steel wheel has low carbon content, thermal fatigue resistance performance of the wheel is improved, generation of thermal cracks on the rim is prevented, the number of times of repairing by turning and an amount of repairing by turning are reduced, the service efficiency of the rim metal is improved, and a service life of the wheel is prolonged.

Chinese Patent Publication No. CN1800427A published on Jul. 12, 2006 and entitled with "Bainite Steel For Railroad Carriage Wheel" discloses that chemical compositions (wt %) of steel are: carbon C: 0.08-0.45%, silicon Si: 0.60-2.10%, manganese Mn: 0.60-2.10%, molybdenum Mo: 0.08-0.60%, nickel Ni: 0.00-2.10%, chromium Cr: <0.25%, vanadium V: 0.00-0.20%, and copper Cu: 0.00-1.00%. A typical structure of the bainite steel is carbide-free bainite, which has excellent strength and toughness, low notch sensitivity, and good hot-crack resistance performance. The addition of the element Mo can increase hardenability of the steel. However, for a wheel having a large cross-section, there is a great difficulty in controlling production, and costs are relatively high.

British Steel Corporation Patent No. CN1059239C discloses bainite steel and a production process thereof. Chemical compositions (wt %) of the steel are: carbon C: 0.05-0.50%, silicon Si and/or aluminum Al: 1.00-3.00%, manganese Mn: 0.50-2.50%, and chromium Cr: 0.25-2.50%. A typical structure of the bainite steel is carbide-free bainite, which has high wearability and rolling contact fatigue resistance performance. Although the steel has good strength and toughness, a cross section of a steel rail is relatively simple, impact toughness performance at 20° C. is not high, and costs of the steel are high.

SUMMARY

An objective of the present invention is to provide a low cost lean production bainitic steel wheel for rail transit and a manufacturing method therefor. Components are designed to be a Si—Mn-RE system, without particularly adding alloying elements such as Mo, Ni, V, Cr, and B, and a preparation technology, especially a heat treatment process and technology is fully used, to greatly reduce costs of steel and realize lean production.

The present invention further provides a manufacturing method for the low cost lean production bainitic steel wheel for rail transit. The heat treatment process is innovated so that the typical structure of a rim is carbide-free bainite and excellent comprehensive properties are obtained.

The low cost lean production bainitic steel wheel for rail transit provided in the present invention contains elements with the following weight percentages:

carbon C: 0.15-0.45%, silicon Si: 1.00-2.50%, manganese Mn: 1.20-3.00%, rare earth RE: 0.001-0.040%, phosphorus P≤020%, and sulphur S≤020%, where the remaining is iron and unavoidable residual elements; and 3.00%≤Si+Mn≤5.00%.

Preferably, the low cost lean production bainitic steel wheel for rail transit contains elements with the following weight percentages:

carbon C: 0.19-0.28%, silicon Si: 1.40-1.90%, manganese Mn: 1.50-2.20%, rare earth RE: 0.020-0.040%, phosphorus P≤020%, and sulphur S≤020%, where the remaining is iron and unavoidable residual elements, and 3.00%≤Si+Mn≤5.00%.

More preferably, the low cost lean production bainitic steel wheel for rail transit contains elements with the following weight percentages:

carbon C: 0.25%, silicon Si: 1.55%, manganese Mn: 1.68%, rare earth RE: 0.037%, phosphorus P: 0.007%, and sulphur S: 0.010%, where the remaining is iron and unavoidable residual elements.

The obtained microstructure of the wheel is: the metallographic structure within 40 millimetres below a rim tread of the wheel is a carbide-free bainite structure, namely, supersaturated lathy ferritic in nanometer scale, where film-shaped carbon-rich residual austenite in nanometer scale exists in the middle of the supersaturated lathy ferritic in nanometer scale, and a volume percentage of the residual austenite is 4%-15%. The nanometer scale refers to a length of 1 nanometer to 999 nanometers.

The wheel provided in the present invention may be used for production of freight car wheels, and other elements and similar elements in rail transit.

The manufacturing method for the low cost lean production bainitic steel wheel for rail transit provided in the present invention includes smelting, refining, molding, and heat treatment processes. The smelting, refining, and molding processes use the prior art, and the heat treatment process is: heating a molded wheel to austenite temperature, intensively cooling a rim tread with a water spray to a temperature below 400° C., and performing tempering treatment. The heating to the austenite temperature is specifically: heating to 860-930° C. and maintaining at the temperature for 2.0-2.5 hours. The tempering treatment is: performing tempering at medium or low temperature for more than 30 minutes when the temperature of the wheel is less than 400° C., and air cooling the wheel to room temperature after the tempering; or intensively cooling the rim tread with the water spray to the temperature below 400° C., and air cooling to room temperature, during which self-tempering is performed by using waste heat.

The heat treatment process may alternatively be: Heating treatment of the wheel with high-temperature waste heat after the molding, and directly intensively cooling a rim tread of a molded wheel with a water spray to a temperature below 400° C., and performing tempering treatment. The tempering treatment is: performing tempering at medium or low temperature for more than 30 minutes when the temperature of the wheel is less than 400° C., and air cooling the wheel to room temperature after the tempering; or intensively cooling the rim tread with the water spray to the temperature below 400° C., and air cooling to room temperature, during which self-tempering is performed by using waste heat.

The heat treatment process may alternatively be: air cooling the wheel to a temperature below 400° C. after the wheel is molded, and performing tempering treatment. The tempering treatment is: performing tempering at medium or low temperature for more than 30 minutes when the temperature of the wheel is less than 400° C., and air cooling the wheel to room temperature after the tempering; or air cooling to a temperature below 400° C., and air cooling to room temperature, during which self-tempering is performed by using waste heat.

Specifically, the heat treatment process is any one of the following:

heating the wheel to the austenite temperature, intensively cooling the rim tread with the water spray to the temperature below 400° C., and air cooling to room temperature, during which self-tempering is performed by using waste heat; or heating the wheel to the austenite temperature, intensively cooling the rim tread with the water spray to the temperature below 400° C., performing tempering at medium or low temperature for more than 30 minutes when the temperature of the wheel is less than 400° C., and air cooling to room temperature after the tempering, where the heating to the austenite temperature is specifically: heating to 860-930° C. and maintaining at the temperature for 2.0-2.5 hours; or heating treatment of the wheel with high-temperature waste heat after the molding, and intensively cooling the rim tread with the water spray to the temperature below 400° C., and air cooling to room temperature, during which self-tempering is performed by using waste heat; or heating treatment of the wheel with high-temperature waste heat after the molding, and intensively cooling the rim tread with the water spray to the temperature below 400° C., performing tempering at medium or low temperature for more than 30 minutes when the temperature of the wheel is less than 400° C., and air cooling to room temperature after the tempering; or after the wheel is molded, air cooling the wheel to the temperature below 400° C., and then performing self-tempering by using the waste heat after the molding; or after the wheel is molded, air cooling the wheel to the temperature below 400° C., performing tempering at medium or low temperature for more than 30 minutes when the temperature of the wheel is less than 400° C., and air cooling to room temperature after the tempering.

Functions of the elements in the present invention are as follows:

C content: is a basic element in the steel and has strong functions of interstitial solution hardening and precipitation strengthening. As the carbon content increases, strength of the steel is improved and toughness of the steel is reduced. The solubility of carbon in austenite is far greater than that in ferritic, and carbon is a valid austenite-stabilizing element. The volume fraction of carbide in the steel is in direct proportion to the carbon content. To obtain a carbide-free bainite structure, it needs to be ensured that particular C content dissolves in supercooled austenite and supersaturated ferritic, thereby effectively improving strength and hardness of the material, especially yield strength of the material. When the C content is higher than 0.45%, cementite is precipitated, reducing toughness of the steel. When the C content is lower than 0.15%, supersaturation of ferritic is reduced, and the strength of the steel is reduced. Therefore, a proper range of the carbon content is preferably 0.15-0.45%.

Si content: is a basic alloying element in the steel, and is a common deoxidizer. The atomic radius of Si is less than the atomic radius of iron, and Si has a strong solution strengthening function on austenite and ferritic. In this way, shear strength of the austenite is improved. Si is a noncarbide former, which improves activity of carbon in the steel and supersaturation of carbon in ferritic, to achieve an objective of improving yield strength of the steel. Si prevents precipitation of cementite, facilitates formation of a bainite-ferritic carbon-rich austenite film and (M-A) island-type structure, and is a main element for obtaining the carbide-free bainitic steel. Si can further prevent precipitation of cementite, thereby preventing precipitation of carbide due to decomposition of supercooled austenite. When tempering is performed at 300° C.-400° C., precipitation of cementite is completely suppressed, thereby improving thermal stability and mechanical stability of the austenite. When the Si content in the steel is higher than 2.50%, a tendency of precipitating proeutectoid ferritic is increased, and strength and toughness of the steel are reduced. When the Si content is lower than 1.00%, cementite is easily precipitated from the steel, and a carbide-free bainitic structure is not easily obtained. Therefore, the Si content should be controlled from 1.00-2.50%.

Mn content: Mn is an austenite stabilization element, which improves hardenability of the steel, and improves mechanical properties of the steel. By properly adjusting alloying content of Si and Mn, a film-shaped austenite structure, that is, carbide-free bainite, precipitated from noncarbide and spaced between bainite ferritic laths is obtained. Mn can also improve a diffusion coefficient of P and improve brittleness of the steel. When the Mn content is lower than 1.20%, the hardenability of the steel is poor, which is adverse to obtaining carbide-free bainite. When the Mn content is higher than 3.00%, the hardenability of the steel is significantly improved. In addition, a diffusion tendency of P is also greatly improved, and toughness of the steel is reduced. Therefore, the Mn content should be controlled from 1.20-3.00%.

When total content of Si and Mn is lower than 3%, hardenability of the steel is reduced, and a carbide is easily produced in the steel, which is adverse to obtaining a carbide-free bainite structure having good strength and toughness. When total content of Si and Mn is higher than 5%, hardenability of the steel is excessively high, undesirable structures such as martensite are easily formed, and there is a great difficulty in controlling production.

RE content: An RE element is added to refine austenite grains, which has functions of purification and modification, and can reduce segregation of harmful impurity elements along a grain boundary and improve and strengthen the grain boundary, thereby improving strength and toughness of the steel. In addition, RE can facilitate spheroidization of inclusions, to further improve the toughness of the steel and reduce notch sensitivity of the material. When the RE content is excessively high, the beneficial effect is reduced, and production costs of the steel are increased. When the RE content is lower than 0.001%, harmful elements cannot be completely removed to generate tough rare earth inclusions. When the RE content is higher than 0.040%, RE elements are redundant, and a function of the RE elements cannot be effectively played. Considering all conditions, the RE content is controlled from 0.001-0.040%.

P content: P is prone to grain boundary segregation in medium and high carbon steel, to weaken a grain boundary and reduce strength and toughness of the steel. As a harmful element, when P≤020%, the performance is not greatly adversely affected.

S content: S is prone to grain boundary segregation, and easily forms an inclusion together with other elements, thereby reducing strength and toughness of the steel. As a harmful element, when S≤020%, the performance is not greatly adversely affected.

In the present invention, the chemical components of the steel use inexpensive alloying elements Si and Mn, where Si is a noncarbide former, to improve activity of carbon in the ferritic, and defer and inhibit precipitation of carbide. In addition, the Mn element has a good austenite stabilization function, to improve the hardenability and the strength of the steel. The rare earth element has a function of absorbing harmful gas such as hydrogen in the steel, to spheroidize the unavoidable inclusions in the steel, so as to further improve the toughness of the steel. By properly adjusting the content of Si, Mn, and RE, the rim obtains the carbide-free bainite structure precipitated from noncarbide, to further improve strength and toughness of the wheel, thereby realizing low-cost lean production while satisfying mechanical properties of the wheel. Moreover, the alloying elements such as Mo, V, Ni, Cr, and B, are not particularly added. Therefore, costs of the steel are low. Lean production is realized by simplifying a process.

In addition, by using a proper molding process (including forging and rolling, mold casting, or the like), especially the heat treatment process in the design of the present invention, the rim tread is intensively cooled with the water spray according to a formulation of the alloying elements of the wheel steel, so that the rim of the wheel obtains the carbide-free bainite structure, namely, the supersaturated lathy ferritic in nanometer scale, in the middle of which the film-shaped carbon-rich residual austenite in nanometer scale exists, where the residual austenite is 4%-15%.

Self-tempering using the waste heat or tempering at medium or low temperature is performed on a composite structure based on the carbide-free bainite structure, to further improve structure stability of the wheel and the comprehensive mechanical properties of the wheel, so that the wheel has characteristics such as excellent strength and toughness and low notch sensitivity.

According to the present invention, the chemical components of the bainite steel are designed to be a C—Si—Mn-RE system, without particularly adding the alloying elements such as Mo, Ni, V, Cr, and B, and by controlling the heat treatment process, the typical structure of the rim is carbide-free bainite, namely, the supersaturated lathy ferritic in nanometer scale, in the middle of which the film-shaped carbon-richresidual austenite in nanometer scale exists, where the residual austenite is 4%-15%. The wheel has characteristics such as excellent strength and toughness and low notch sensitivity. The steel provided in the present invention is low in costs and has ordinary hardenability. The rare earth element can spheroidize the inclusions in the steel, and strengthen the grain boundary. The steel can obtain good comprehensive mechanical properties by using advanced heat treatment process.

Compared with the prior art, through the foregoing alloying design and the manufacturing process, the rim of the wheel obtains the carbide-free bainite structure, and the web and the wheel hub obtain granular bainite, a supersaturated ferritic structure structure, and a small amount of pearlite. Compared with the CL60 wheel, for the bainite steel wheel prepared in the present invention, matching between the strength and the toughness of the rim is obviously improved, so as to effectively improve, while ensuring safety, the yield strength, the toughness, and the low-temperature toughness of the wheel, the rolling contact fatigue (RCF) resistance performance of the wheel, and the hot-crack resistance performance of the wheel, reduce the notch sensitivity of the wheel, reduce a probability of peeling or flaking of the wheel in use, implement even wear and less repairing by turning of the tread of the wheel, improve the service efficiency of the rim metal of the wheel, and improve the service life and comprehensive efficiency of the wheel. In addition, a friction and wear surface of contact between a wheel and a rail is not prone to a "bright layer", but generates a nanocrystal or noncrystal, thereby reducing the coefficient of friction between the wheel and the rail, improving running efficiency, and reducing wear of the steel rail. The present invention brings specific economic and social benefits. Moreover, the chemical components of the steel use inexpensive alloying elements Si and Mn, to reduce costs and realize lean production.

DETAILED DESCRIPTION

Weight percentages of chemical components of a wheel steel in Embodiments 1, 2, and 3 are shown in Table 2. In Embodiments 1, 2, and 3, a (1:0380 mm round billet directly cast after EAF smelting, and LF+RH refining and vacuum degassing is used. Then, the round billet forms a freight car wheel having a diameter of 840 mm after ingot cutting, heating and rolling, heat treatment, and finishing.

Embodiment 1

A low cost lean production bainitic steel wheel for rail transit contains elements with the following weight percentages shown in Table 2.

A manufacturing method for the low cost lean production bainitic steel wheel for rail transit includes the following steps:

forming the wheel by using liquid steel in Embodiment 1 with chemical components shown in Table 2 through an EAF steelmaking process, an LF refining process, an RH vacuum treatment process, a round billet continuous casting process, an ingot cutting and rolling process, a heat treatment process, processing, and a finished product detection process. The heat treatment process is: heating to 860-930° C. and maintaining at the temperature for 2.0-2.5 hours; intensively cooling a rim with a water spray to a temperature below 400° C., performing self-tempering by using waste heat, and cooling to room temperature after the tempering, without performing additional tempering treatment.

Figure 1:
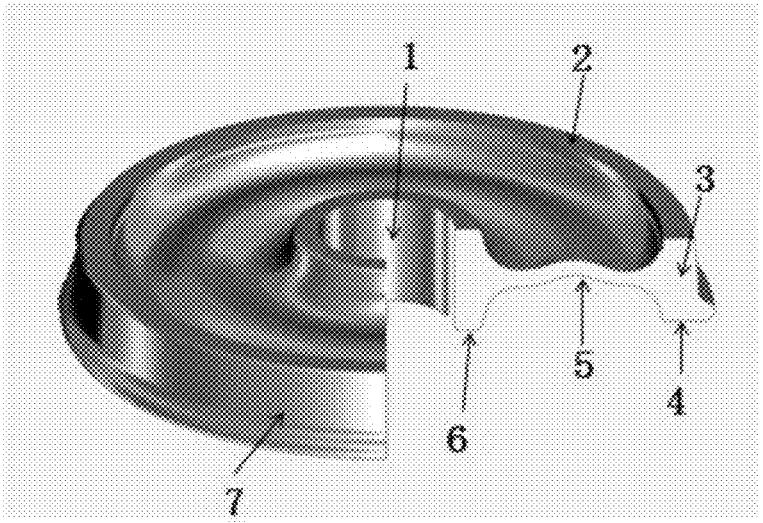
FIG. 1 is a schematic diagram of names of parts of a wheel, where 1: wheel hub hole; 2: outer side face of a rim; 3: rim; 4: inner side face of the rim; 5: web; 6: wheel hub; and 7: tread.
Figure 2:
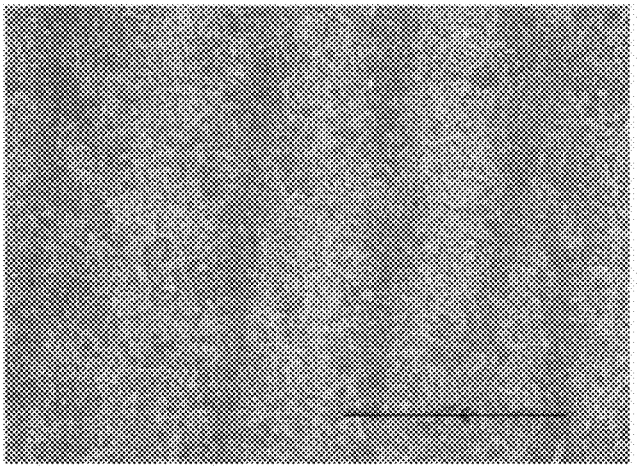
FIG. 2*a* is a diagram of a 100× optical metallographic structure of a rim according to Embodiment 1.
FIG. 2*b* is a diagram of a 500× optical metallographic structure of a rim according to Embodiment 1.
Figure 2:
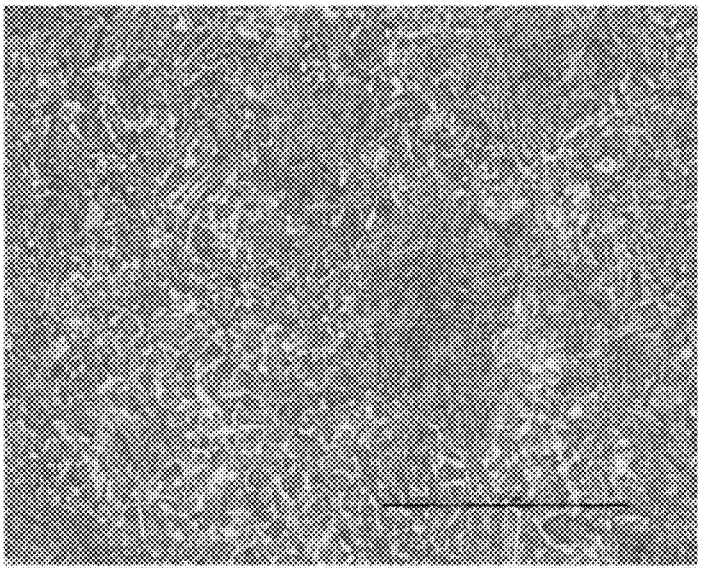

As shown in FIG. 2*a* and FIG. 2*b*, a metallographic structure of a rim of the wheel prepared in this embodiment is mainly carbide-free bainite plus a small amount of ferritic. Mechanical properties of the wheel in this embodiment are shown in Table 3, and matching between strength and toughness of the wheel is superior to that of a CL60 wheel.

Embodiment 2

A low cost lean production bainitic steel wheel for rail transit contains elements with the following weight percentages shown in Table 2.

A manufacturing method for the low cost lean production bainitic steel wheel for rail transit includes the following steps:

forming the wheel by using liquid steel in Embodiment 2 with chemical components shown in Table 2 through an EAF steelmaking process, an LF refining process, an RH vacuum treatment process, a round billet continuous casting process, an ingot cutting and rolling process, a heat treatment process, processing, and a finished product detection process. The heat treatment process is: heating to 860-930° C. and maintaining at the temperature for 2.0-2.5 hours; cooling a rim with a water spray to a temperature below 400° C., performing self-tempering by using waste heat, and cooling to room temperature after the tempering, without performing additional tempering treatment.

Figure 3:
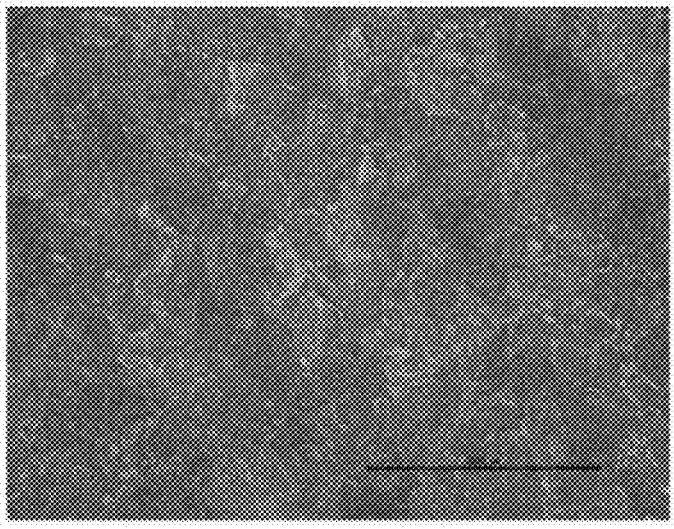
FIG. 3*a* is a diagram of a 100× optical metallographic structure of a rim according to Embodiment 2.
FIG. 3*b* is a diagram of a 500× optical metallographic structure of a rim according to Embodiment 2.
FIG. 3*c* is a diagram of a 500× dyed metallographic structure of a rim according to Embodiment 2.
FIG. 3*d* is a diagram of a transmission electron microscope structure of a rim according to Embodiment 2.
Figure 3:
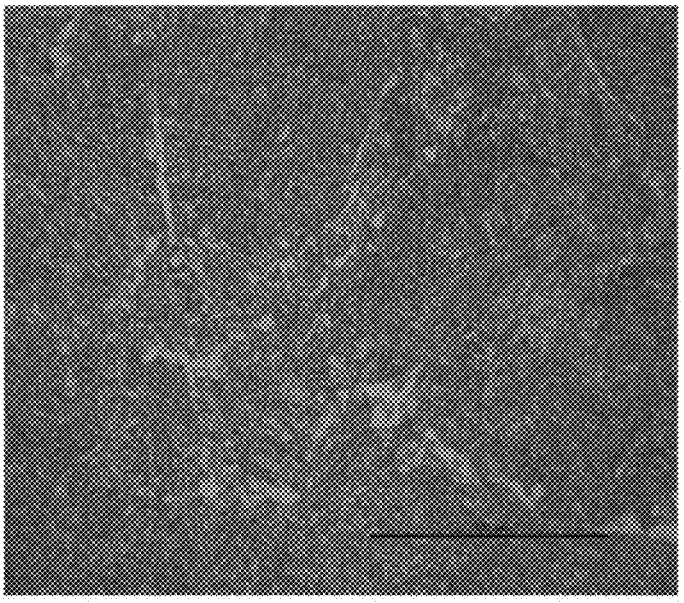
Figure 3:
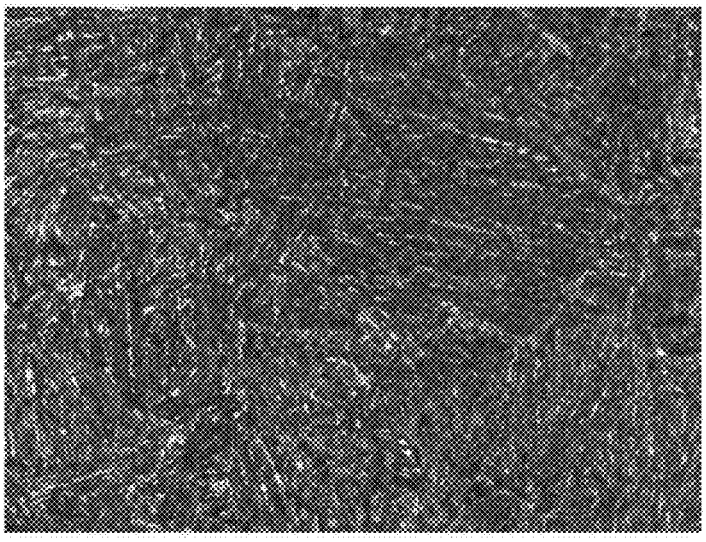
Figure 3:
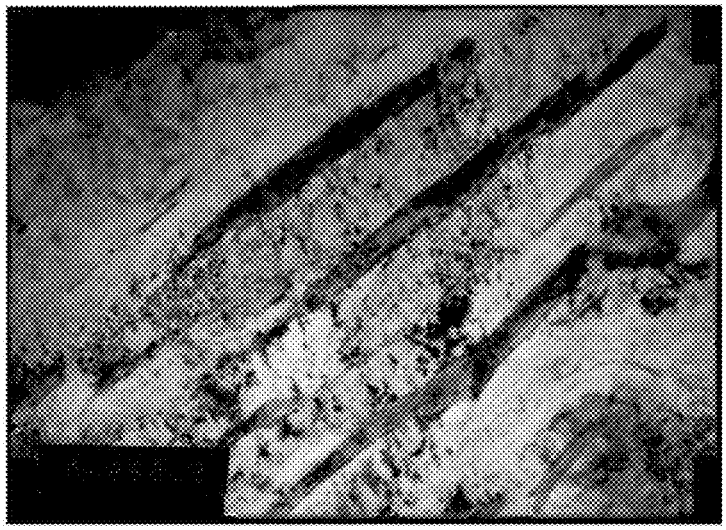

As shown in FIG. 3, a metallographic structure of a rim of the wheel prepared in this embodiment is mainly carbide-free bainite. Mechanical properties of the wheel in this embodiment are shown in Table 3. FIG. 3*a*, FIG. 3*b*, FIG. 3*c*, and FIG. 3*d*, and matching between strength and toughness of the wheel is superior to that of a CL60 wheel.

Embodiment 3

A low cost lean production bainitic steel wheel for rail transit contains elements with the following weight percentages shown in Table 2.

A manufacturing method for the low cost lean production bainitic steel wheel for rail transit includes the following steps:

forming the wheel by using liquid steel in Embodiment 3 with chemical components shown in Table 2 through an EAF steelmaking process, an LF refining process, an RH vacuum treatment process, a round billet continuous casting process, an ingot cutting and rolling process, a heat treatment process, processing, and a finished product detection process. The heat treatment process is: heating to 870-890° C. and maintaining at the temperature for 2.0-2.5 hours; cooling a rim tread with a water spray to a temperature below 400° C., performing self-tempering by using waste heat, and cooling to room temperature after the tempering, without performing additional tempering treatment.

Figure 4:
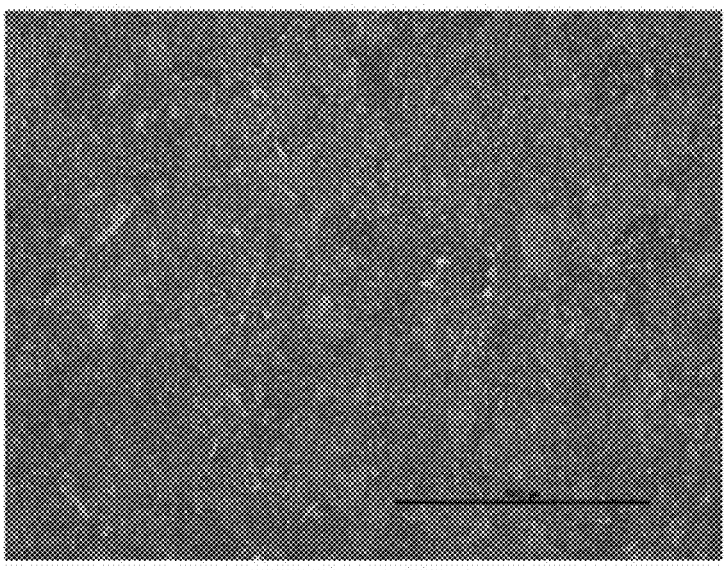
FIG. 4*a* is a diagram of a 100× optical metallographic structure of a rim according to Embodiment 3.
FIG. 4*b* is a diagram of a 500× optical metallographic structure of a rim according to Embodiment 3.
Figure 4:
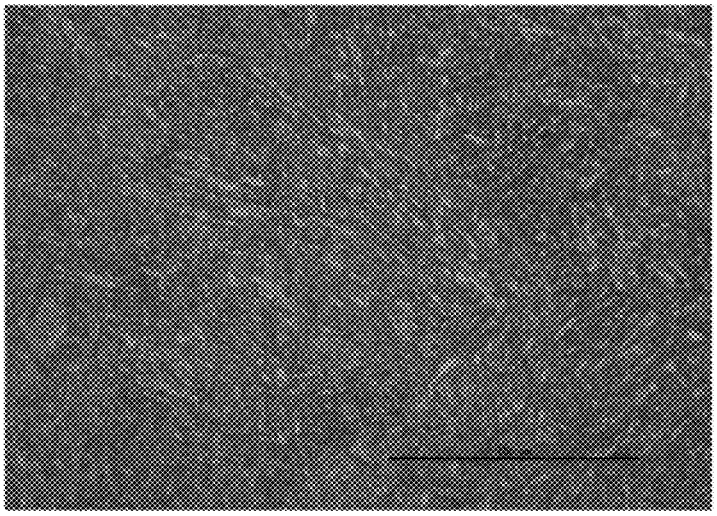
Figure 5:
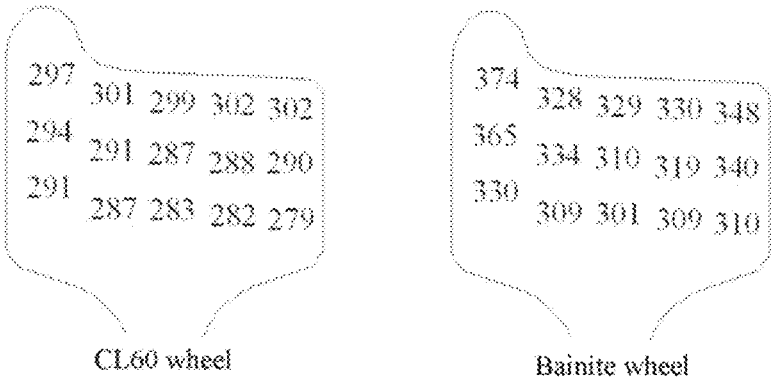
FIG. 5 shows hardness comparison between cross sections of rims of a wheel according to Embodiment 2 and a CL60 wheel.
Figure 6:
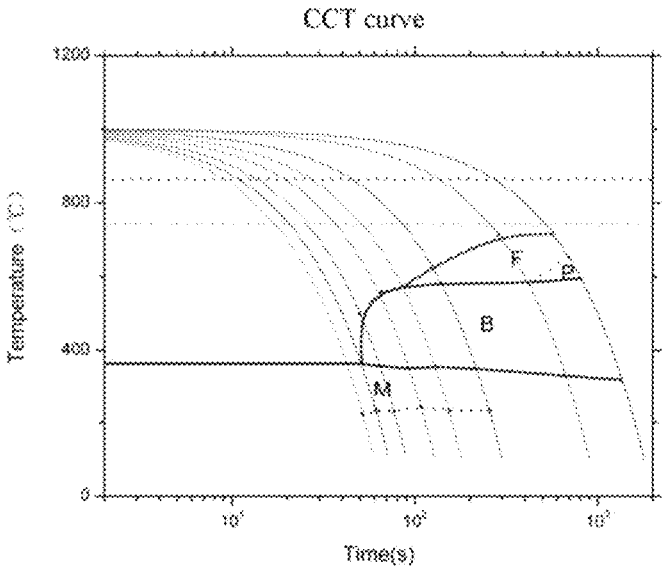
FIG. 6 is a continuous cooling transformation curve (CCT curve) of steel according to Embodiment 2.
Figure 7:
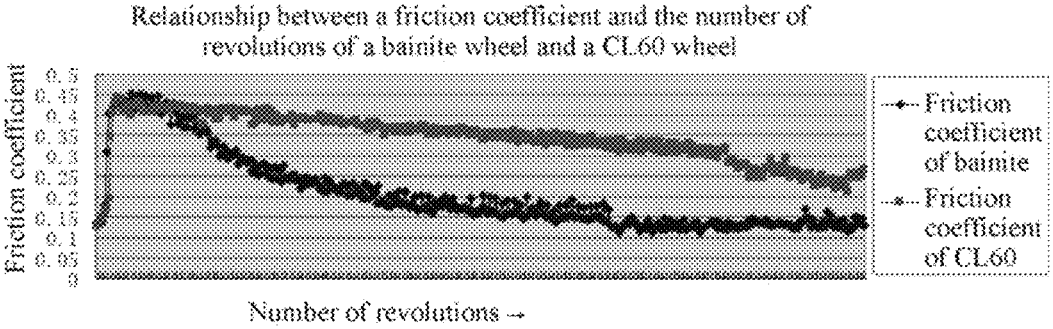
FIG. 7 shows a relationship comparison between a friction coefficient and the number of revolutions in a friction and wear test of a wheel according to Embodiment 2 and a CL60 wheel.
Figure 8:
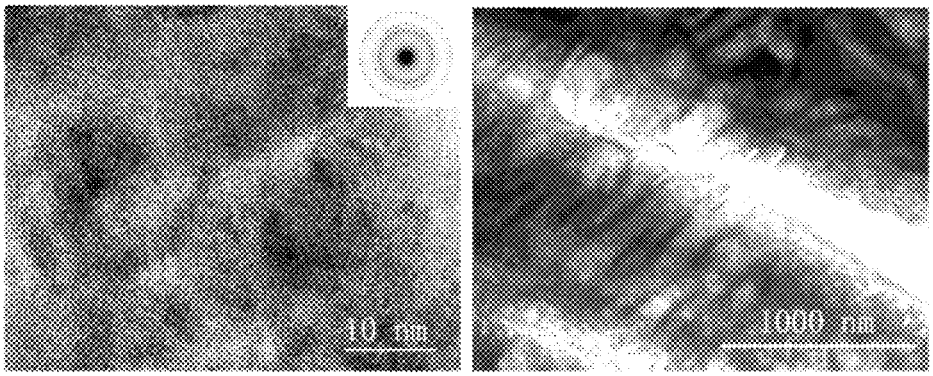
FIG. 8 shows structures of deformation layers on surfaces of samples of a wheel according to Embodiment 2 and a CL60 wheel after a friction and wear test.

As shown in FIG. 4*a* and FIG. 4*b*, a metallographic structure of a rim of the wheel prepared in this embodiment is mainly carbide-free bainite. Mechanical properties of the wheel in this embodiment are shown in Table 3, and matching between strength and toughness of the wheel is superior to that of a CL60 wheel.

TABLE 2

Chemical components (wt %) of wheels in Embodiments 1, 2, and 3 and comparison examples.

| Embodiment and example | C | Si | Mn | RE | P | S |
|---|---|---|---|---|---|---|
| Embodiment 1 | 0.32 | 2.01 | 1.22 | 0.010 | 0.011 | 0.009 |
| Embodiment 2 | 0.25 | 1.55 | 1.68 | 0.037 | 0.010 | 0.007 |
| Embodiment 3 | 0.18 | 1.72 | 2.45 | 0.022 | 0.014 | 0.010 |
| CL60 wheel | 0.63 | 0.24 | 0.71 | / | 0.010 | 0.001 |
| Chinese Patent CN100395366C | 0.20 | 1.50 | 1.80 | / | / | / |
| UK Patent CN1059239C | 0.22 | 0.5-3.0 | 0.5-2.5 | / | / | / |

The foregoing are chemical components of the wheel, and the remaining is iron and unavoidable impurities.

TABLE 3

Mechanical properties of rims of wheels in Embodiments 1, 2, and 3 and comparison examples

| Embodiment and example | $Rp_{0.2}$ MPa | Rm MPa | A % | Z % | Cross-section hardness HB | Room temperature KU J | Kq MPa · $m^{1/2}$ |
|---|---|---|---|---|---|---|---|
| Embodiment 1 | 671 | 1102 | 16 | 40 | 332 | 51 | 83.3 |
| Embodiment 2 | 612 | 976 | 16.5 | 42 | 301 | 60 | 91.2 |
| Embodiment 3 | 621 | 1007 | 17 | 42 | 312 | 55 | 86.6 |
| CL60 wheel | 630 | 994 | 15.5 | 39 | 290 | 25 | 56.3 |
| Chinese Patent CN100395366C | 779 | 1198 | 16 | 40 | 360 | 52 | / |
| UK Patent CN1059239C | 730 | 1250 | 17 | 55 | 400 | 39 | 60 (−20° C.) |

What is claimed is:

1. A manufacturing method for a bainitic steel wheel for rail transit, comprising smelting, molding, and heat treatment process, wherein the heat treatment process is: heating a molded wheel to austenite temperature, cooling a rim tread with a water spray to decrease a temperature of the wheel below 400° C., and performing tempering treatment, wherein performing the tempering treatment includes: performing tempering at a first temperature for more than 30 minutes when the temperature of the wheel is less than 400° C., and air cooling the wheel to room temperature after the tempering, and wherein the bainitic steel wheel for rail transit consists of elements with the following weight percentages:

carbon C: 0.15-0.45%, silicon Si: 1.00-2.50%, manganese Mn: 1.20-3.00%, rare earth RE: 0.001-0.040%, phosphorus P≤0.020%, and sulphur S≤0.020%, wherein the remaining is iron and unavoidable residual elements, and 3.00%≤Si+Mn≤5.00%.

2. The manufacturing method according to claim 1, wherein the heating of the molded wheel to the austenite temperature includes: heating to a second temperature in a range of 860-930° C. and maintaining at the second temperature for 2.0-2.5 hours.

3. The manufacturing method according to claim 1, wherein the heat treatment process can alternatively be: heating treatment of the wheel with waste heat after the molding, and cooling a rim tread of a molded wheel with a water spray to a temperature below 400° C., and performing tempering treatment.

4. The manufacturing method according to claim 1, wherein the heat treatment process can alternatively be: air cooling the wheel to decrease a temperature of the wheel below 400° C. after the wheel is molded, and performing tempering treatment.

5. A manufacturing method for a bainitic steel wheel for rail transit, comprising smelting, molding, and heat treatment process, wherein the heat treatment process is: heating a molded wheel to austenite temperature, cooling a rim tread with a water spray to decrease a temperature of the wheel below 400° C., and performing tempering treatment, wherein the tempering treatment includes: performing tempering at a first temperature for more than 30 minutes when the temperature of the wheel is less than 400° C., and air cooling the wheel to room temperature after the tempering, and wherein the bainitic steel wheel for rail transit consists of elements with the following weight percentages:

carbon C: 0.19-0.28%, silicon Si: 1.40-1.90%, manganese Mn: 1.50-2.20%, rare earth RE: 0.020-0.040%, phosphorus P≤0.020%, and sulphur S≤0.020%, wherein the remaining is iron and unavoidable residual elements, and 3.00%≤Si+Mn≤5.00%.

6. The manufacturing method according to claim 5, wherein the heating of the molded wheel to the austenite temperature includes: heating to a second temperature in a range of 860-930° C. and maintaining at the second temperature for 2.0-2.5 hours.

7. The manufacturing method according to claim 5, wherein the heat treatment process can alternatively be: heating treatment of the wheel with waste heat after the molding, and cooling a rim tread of a molded wheel with a water spray to decrease a temperature of the wheel below 400° C., and performing tempering treatment.

8. The manufacturing method according to claim 5, wherein the heat treatment process can alternatively be: air cooling the wheel to decrease a temperature of the wheel below 400° C. after the wheel is molded, and performing tempering treatment.

* * * * *